United States Patent [19]

Wilhoite

[11] 4,292,954

[45] Oct. 6, 1981

[54] WOOD BURNING HEATER

[75] Inventor: Murray O. Wilhoite, Huntsville, Ala.

[73] Assignee: Martin Industries, Inc., Florence, Ala.

[21] Appl. No.: 42,560

[22] Filed: May 25, 1979

[51] Int. Cl.[3] ..... F23L 3/00; F01B 25/00; F27D 19/00

[52] U.S. Cl. ..... 126/290; 415/26; 432/46

[58] Field of Search ..... 126/84, 290, 285.5, 126/67; 432/250; 415/26

[56] References Cited

U.S. PATENT DOCUMENTS

| | | | |
|---|---|---|---|
| 1,352,255 | 9/1920 | Emerson | 126/287.5 |
| 2,604,313 | 7/1952 | Grantham | 432/46 |
| 3,479,947 | 11/1969 | Myers | 415/26 |
| 4,030,479 | 6/1977 | Webb | 126/67 |
| 4,084,744 | 4/1978 | Wilson, Jr. | 126/285.5 |

*Primary Examiner*—Samuel Scott
*Assistant Examiner*—Wesley S. Ratliff, Jr.
*Attorney, Agent, or Firm*—C. A. Phillips

[57] ABSTRACT

A wood burning furnace or space heater having a jacket surrounding a firebox and forming a plenum through which air to be heated is forced by a fan. There is a door in the jacket which automatically opens in the event of a failure of a fan, and thus excessively heated air is immediately released.

11 Claims, 16 Drawing Figures

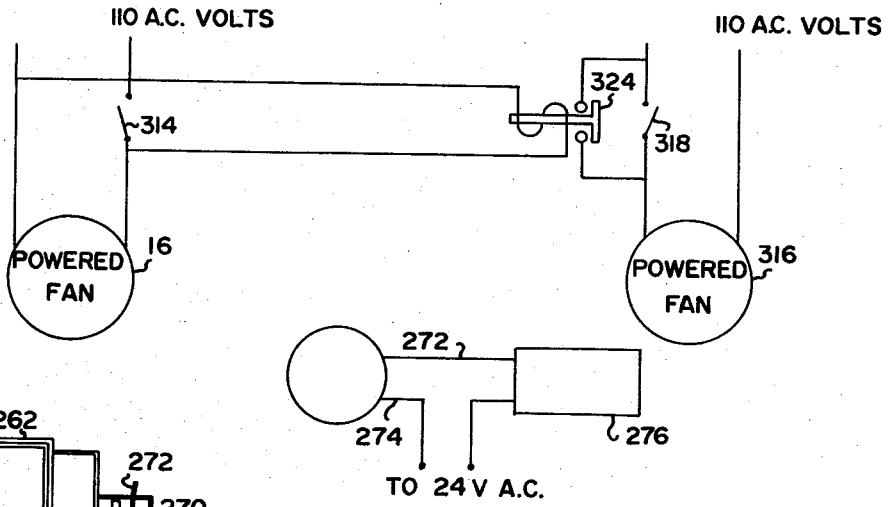
FIG. 13
FIG. 16
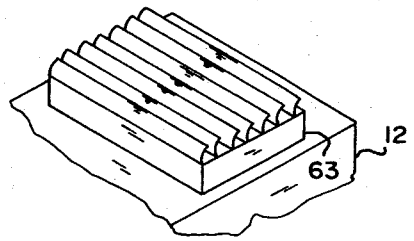
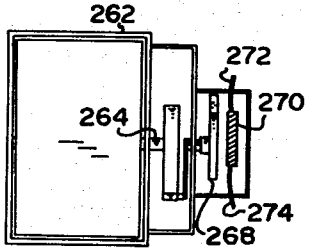
FIG. 12
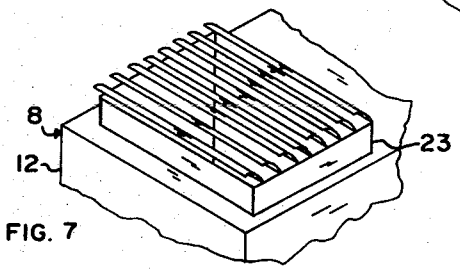
FIG. 7
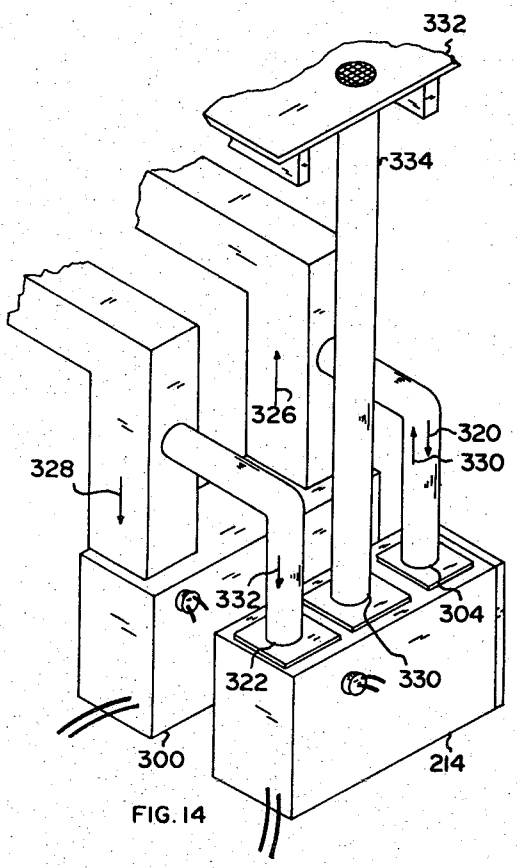
FIG. 14

WOOD BURNING HEATER

BACKGROUND OF THE INVENTION

1. Field of the Invention

This invention relates to combustion type furnaces or heaters, such as wood burning furnaces, in which the heat production cannot be readily reduced, and more particularly to providing a means of allowing overheated air to escape the furnace automatically in the event of a fan failure.

2. General Description of the Prior Art

Wood burning furances generally force air through a heated chamber and into ducting for heat distribution. If for any reason the fan moving the air fails, the air within the furnace and the duct immediate to the furnace quickly becomes overheated. This presents a fire hazard, and the applicant is unaware of any previous means of positively preventing it from happening.

Accordingly, it is the object of this invention to provide an automatic escape means for the overheated air if the fan should turn off with heated air still present.

SUMMARY OF THE INVENTION

In accordance with this invention, a wood burning heater, such as a furnace, has a heat escape door mounted in a horizontal opening in an upper surface of a plenum or jacket which surrounds the combustion chamber of the heater. The door is pivotally mounted slightly off center on a horizontal rod, which is in turn mounted transversely across the horizontal opening. The door is held in a horizontal, or closed, position by air flow passing through the heat jacket, but due to the off center position of the rod, the door assumes a vertical, or open, position if air flow ceases. Other features of the invention are illustrated in the drawings and are described in the detailed description of the drawings.

BRIEF DESCRIPTION OF THE DRAWINGS

FIG. 7 is a broken pictorial view of a vent assembly.

FIG. 12 is a cut-away view of a damper and damper control.

FIG. 13 is an electrical schematic diagram of interconnections to the damper control shown in FIG. 12.

FIG. 14 is a pictorial view of a furnace system employing two furnaces, one of which is a wood burning furnace.

FIG. 16 is an electrical schematic diagram of the electrical interconnection of the furnaces of the system shown in FIG. 14.

DETAILED DESCRIPTION OF THE DRAWINGS

Figure 1:
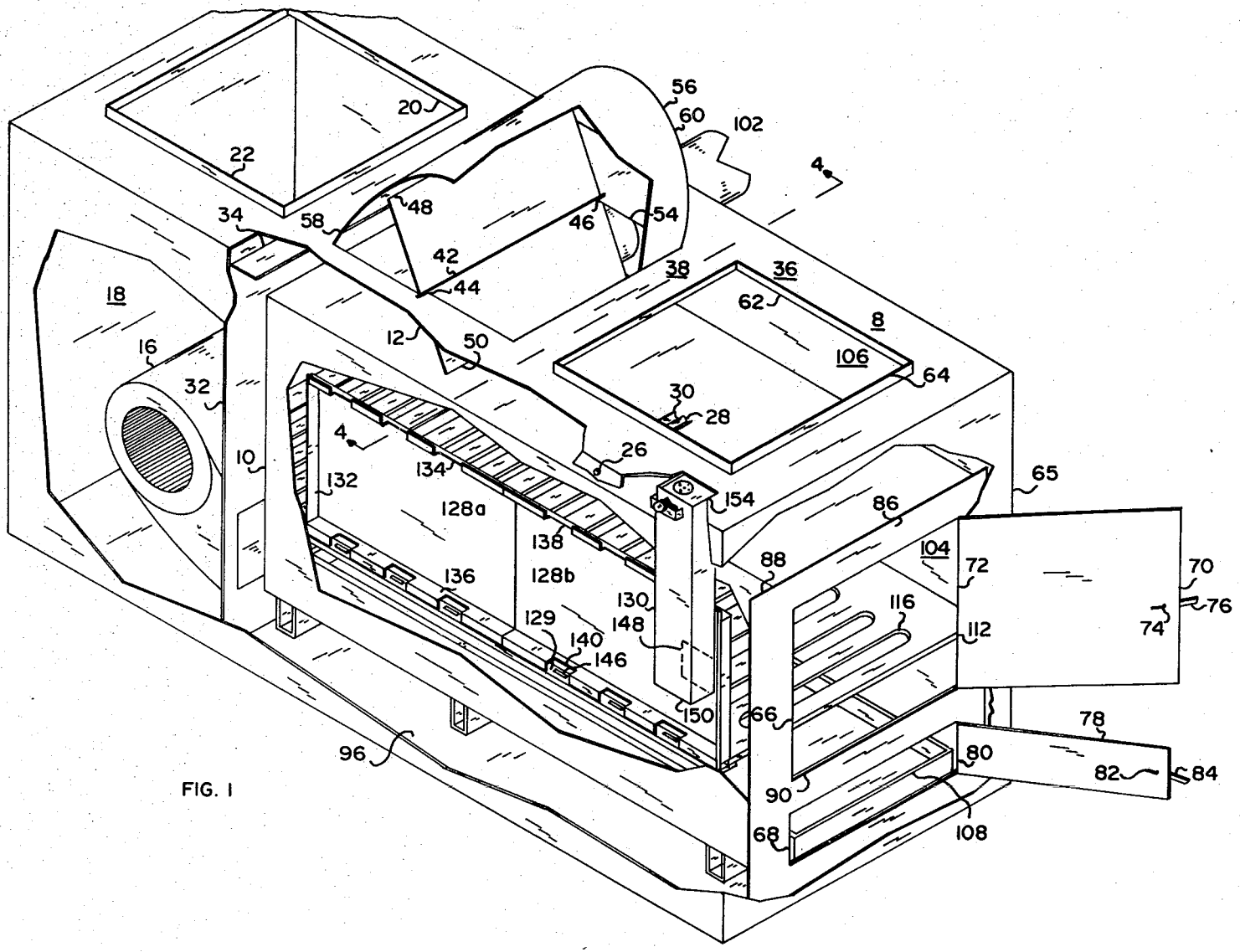
FIG. 1 is a broken pictorial view of an embodiment of the invention.

Referring to the drawings, furnace 8 has a combustion chamber or firebox 10 surrounded by a plenum or jacket 12. Plenum 12 is supplied air (air flow indicated by arrows in FIG. 2) to be heated through opening 14 from blower 16. Fan or blower 16 is enclosed by housing 18 which has an opening 20 adapted to couple by vertical flange 22 to a conventional air duct (not shown). Alternately, a louvered opening 23 would attach to flange 22, and thus to adapt heater 25 to draw air from the immediate air space. With this arrangement, heater 25 would be adapted for use as an immediate space heater, in contrast to the employment of air ducts, to enable it to function as a furnace.

Figure 3:
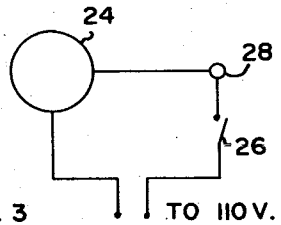
FIG. 3 is a schematic illustration of the electrical components of the embodiment of the invention shown in FIG. 1.

Referring specifically to FIGS. 1 and 3, blower 16 employs motor 24 which is activated by on-off switch 26 electrically coupled through a thermosensitive switch 28 (in some instances this is omitted) which is shielded from direct radiant heat by shield 30, but otherwise responsive to the temperature of air in plenum 12. Common wall 32 separates blower housing 18 from plenum 12 and has on the plenum side horizontal air deflector plate 34 which extends across the upper portion of common wall 32.

Plenum 12 is rectangular and has an upper surface 36 with a rectangular opening 38 which, when blower 16 is operated, is closed by a pivoted plate or door 40, in a manner to be explained. Plate 40 is pivotally attached to transverse horizontal rod 42, which is in turn attached on each side of opening 38 at points 44 and 46. Rod 42 is positioned off center and slightly toward upper end 48 of plate 40, causing plate 40 to naturally assume a tilted or near vertical position with lower end 50 of plate 40 extending into plenum 12. Opening 38 is closed when lower end 50 of plate 40 is rotated upward by the pressure of the blower driven air passing through plenum 12 and against stops 52 and 54 which are integral extensions of surface 36 into opening 38. Plate 40 and opening 36 are covered by semi-circular shroud 56 which is open at ends 58 and 60.

Horizontal opening 62 in plenum 12 has a flange 64 about its peremeter to enable coupling to a conventional air duct (not shown), and in this case, it would be a hot air duct, as opening 62 provides an air outlet for the furnace. Alternatively, as shown in FIG. 7, a louvered opening 63 is attached to flange 64 in keeping with louvered opening 25, enabling complete circulation of air through heater 25 from immediate air space.

End wall 54 of plenum 12 is opposite common wall 32 and has a fuel opening 66, and beneath fuel opening 66 is an ash or residue opening 68. Opening 66 has door 70 which is hinged along edge 72 and seals opening 66 virtually air-tight when held closed by conventional latch 74 operated by connected handle 76. Opening 68 has a door 78 which is hinged along edge 80, and when held closed by a conventional latch 82 and connected handle 84, seals opening 68 virtually air-tight. Openings 66 and 68 open into combustion chamber 10 due to the attachment of wall 86 of combustion chamber 10 and its integral flange 88 to wall 65 of plenum 12, forming common wall 90.

Figure 2:
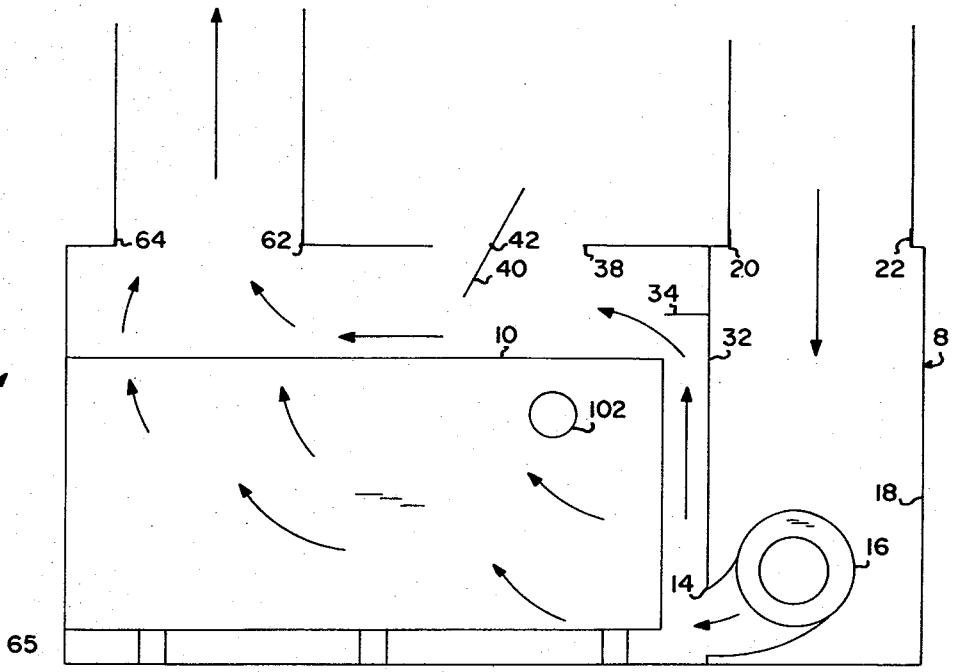
FIG. 2 is a partially schematic, partially diagrammatic, side elevational view of an embodiment of the invention.
Figure 4:
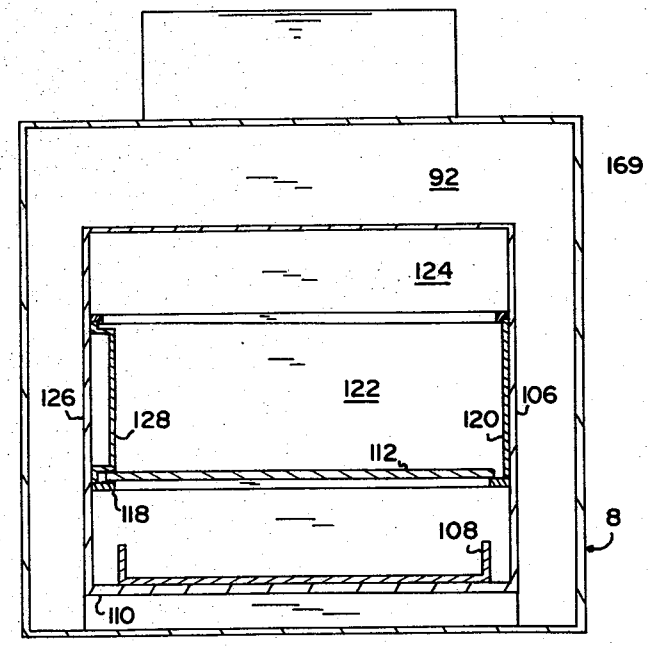
FIG. 4 is a sectional view taken along lines 4—4 of FIG. 1.

As shown in FIGS. 2, 3, and 4, combustion chamber 10 is illustrated as being rectangular in shape and surrounded by plenum 12 with cavity 92 (illustrated in FIGS. 2 and 6) between the two except where the two join in common wall 90. Combustion chamber 10 is supported on floor 94 of plenum 12 by transverse bottom supports 96, 98, and 100.

Flue connection pipe 102 opens through wall 104 of combustion chamber 10 and extends through wall 106 of plenum 12 for connection to a flue pipe (not shown) which would extend outside a building (not shown) containing furnace 8.

A shallow, open-topped rectangular ash box 108 (FIGS. 1 and 4) is positioned on floor 110 of combustion chamber 10 and is removable through ash opening 68. Ash box 108 is beneath fire grate 112 which is a horizontal plate extending the length and width of combustion chamber 10. Fire grate 112 supports firewood or wood fire 114 and includes transverse openings 116 (or a series of holes in place in each transverse opening) which enable the ashes from fire 114 to fall into ash box 108. As shown in FIGS. 1 and 4, grate 112 is supported about its peremeter by horizontal bracket 118 which is rigidly attached to and extends about the inner walls of combustion chamber 10.

Bracket 118 (FIG. 4) also supports vertical plates 120 and 122 which are generally formed of ceramic or heavy cast iron and are attached to and protect side wall 106 and end wall 124, respectively, of combustion chamber 10. Side wall 126 is protected by combustion air chamber 128 (FIG. 1) which is formed of identical opposing halves **128*a* and 128*b* which are supported by portion 129 of bracket 118**.

Air chamber 128 functions as a component of a combustion air injection assembly 130 which is used to control and supply air to the fire for combustion purposes. Chamber 128 extends nearly the length of wall 126, forming a narrow upright box having an open side 132 positioned against wall 126. Upper and lower horizontal surfaces 134 and 136 of chamber 128 have a plurality of identical upper and lower openings 138 and 140 separated by upper and lower vertically extending tabs 142 and 144. Lower openings 140 coincide with corresponding openings 146 in bracket portion 129. Air chamber 128 receives air through opening 148 (represented by dotted lines in FIG. 1) into sealed lower end region 150 of air tube 152. Tube 152 from sealed lower end region 150 extends to open upper end 154 which opens through surface 36.

Figure 5:
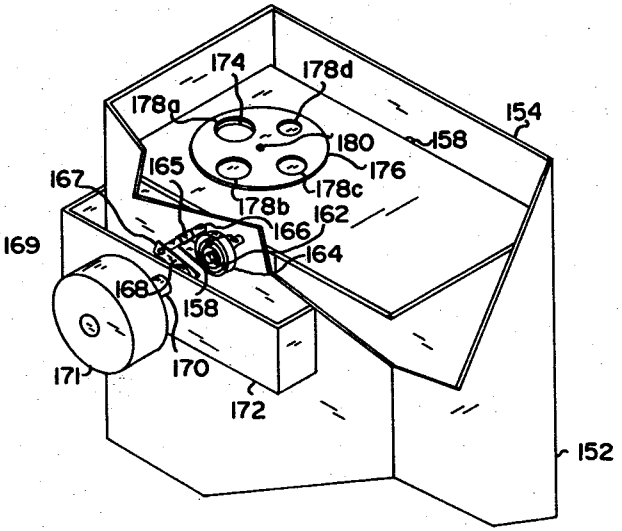
FIG. 5 is a broken pictorial view of a portion of the combustion intake system of the embodiment of the invention.

Referring to FIGS. 1 and 5, open end 154 of tube 152 may be progressively opened or closed by damper plate 156 which is rigidly attached across its center to, and rotates with, horizontal rod 158 which is axially secured in the opposing sides of tube 152. Slotted end 160 of rod 158 extends from tube 152 to engage inner end 162 of coiled temperature sensitive spring 164. Spring 164 is coiled about rod end 160 and terminates in outer looped end 165 which is about rod 166. Rod 166 is attached to end 167 of arm 168 which is rigidly attached at opposite end 169 to shaft 170 of handle 171. Rod 166 rigidly extends from near the periphery of handle 171. Handle 171 rotates with shaft 170 which is axially secured in bracket 172 which extends from tube 152.

Damper plate 156 has opening 174 over which extends circular plate 176. Plate 176 has about its circumference spaced progressively reduced openings **178*a*–178*d* which, when plate 176 is rotated about mounting and pivot point 180, may individually become concentric with opening 174**.

Figure 6:
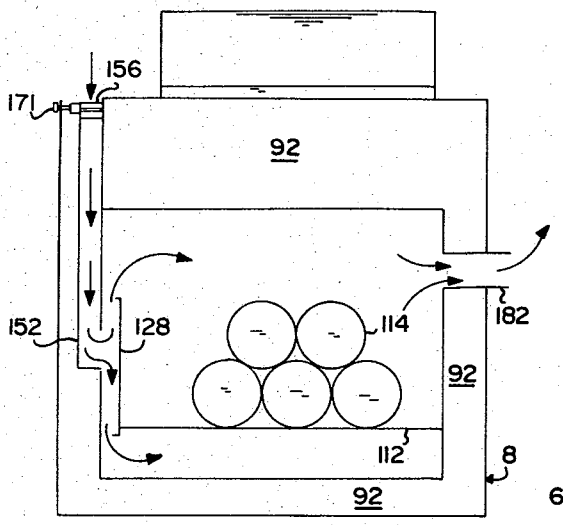
FIG. 6 is a partially schematic, partially diagrammatic, side elevational view of an embodiment of the invention.

In operation, and referring to FIG. 6, burning wood 114, positioned on grate 112, is supplied combustion air as indicated by the arrow via air injection assembly 130. Air enters air injection assembly 130 through open end 154 of tube 152. Damper 156 limits the amount of air entering tube 156, and when in a horizontal or closed position, allows only a minimum amount of air to enter through opening 174, the amount determined by which openings **178*a*–178*d* are positioned concentric to opening 182. Damper 156 may be rotated by handle 171 through spring 164 to a position within tube 156** which will supply the amount of air needed to maintain a desired fire intensity. A fire being supplied a large amount of combustion air will gain in intensity, and a fire limited to a small amount will lose intensity.

For this reason, varying amounts of air needed for a steady production of heat are controlled by temperature sensitive spring 164. Spring 164 will, relative to the position of handle 171 and arm 168, expand and contract as the heat level within plenum 12 rises and falls. This rotates rod 158 and damper 156, closing or opening tube 152, thereby limiting the amount of air reaching the fire. The by-products of combustion exit combustion chamber 10 via flue opening 182 as indicated by the arrows in FIG. 6. It is to be noted that the combustion air is preheated as it passes through tube 152 and chamber 128, thus providing a more efficient medium for combustion as it exits chamber 128 and enters combustion chamber 10 via openings 138 and 140.

The heat from fire 114 radiates from combustion chamber 10 where it heats the air passing through plenum 12. Blower 16 draws air into blower housing 18 through opening 20 from where it is forced into plenum 12 via opening 14. The passing air in plenum 12 closes plate 40 as previously explained, and the air is heated as it passes through plenum 12 and exists via opening 62 into ducting (not shown) for distribution. If the temperature of the air passing through plenum 12 becomes overheated for any reason, and thus it becomes unsafe to permit the air to be passed through heating ducts, e.g., exceeds 200° F., then temperature sensitive switch 28 turns off blower 16. In this event, or if air flow through plenum 12 ceases for any other reason, plate 40 will no longer be biased to a closed position and will rotate to a vertical, open, position. This will allow any overheated air to be immediately exhausted and not fed to duct work where it could create a fire hazard.

Figure 10:
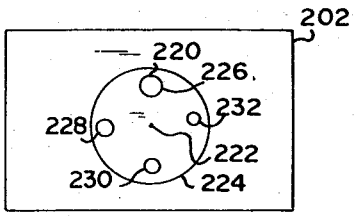
FIG. 10 is an enlarged frontal view of the door assembly shown in FIG. 9.
Figure 9:
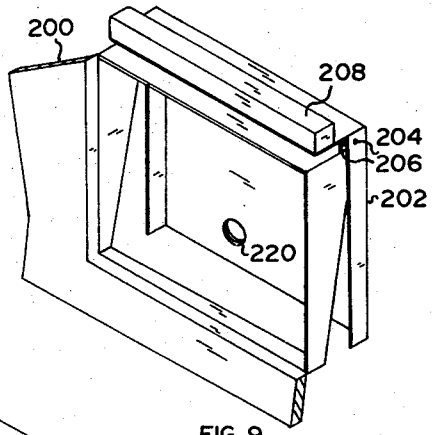
FIG. 9 is an enlarged broken pictorial view of a flash prevention door assembly.
Figure 8:
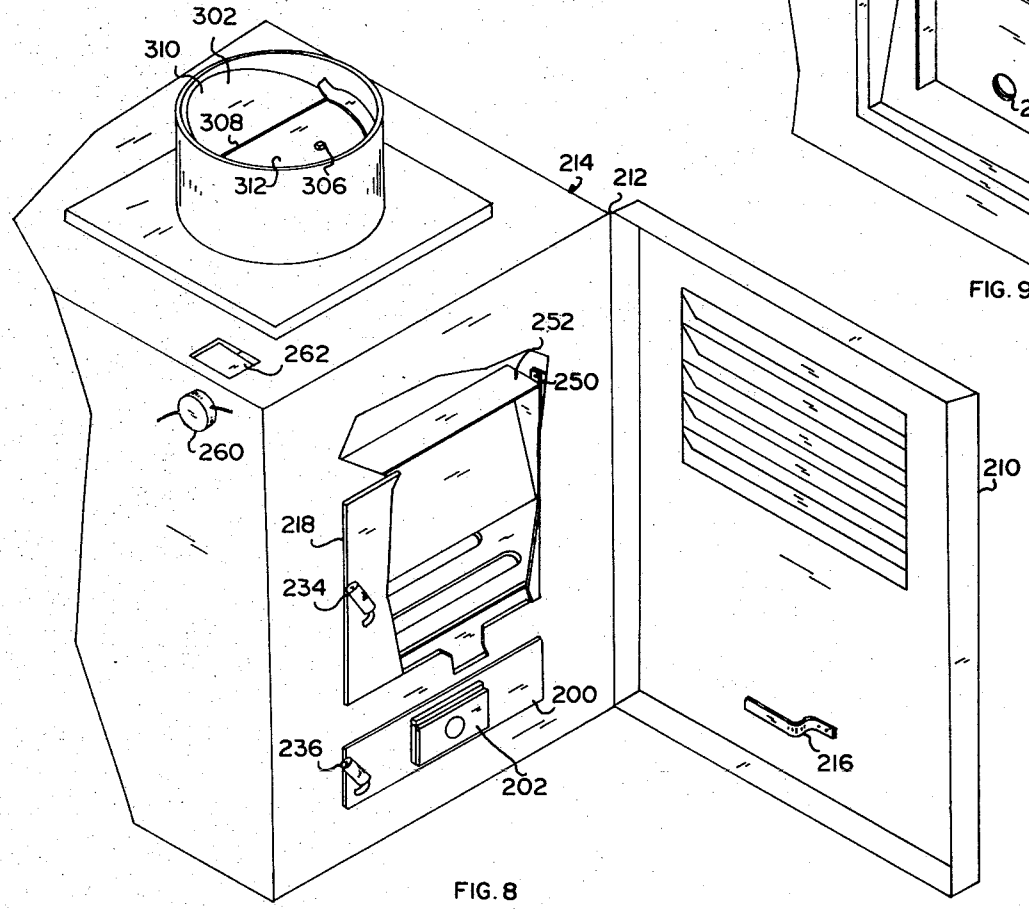
FIG. 8 is a pictorial view illustrating alternate and additional features of the invention.

FIGS. 8–11 illustrate additional features of the invention. Thus, as shown in FIGS. 8–10, ash clean-out door 200 (hinged at right by means not shown) mounts a flat 202 which is pivotally mounted by pin 204 on opposite side flanges 206 attached to door 200. Flap 202 is biased to a normal open position as shown in FIG. 9 by weight 208. An outer furnace door 210 (FIG. 8) is supported on frame 212 of heater 214 and is pivotally mounted (at right by means not shown) to swing from the open position shown in FIG. 8 to a closed position wherein a protrusion on door 210 in the form of bracket 216 would engage flap 202 and cause it to be closed. The function of flap 202 as operated by door 210 is to effect an opening of firebox 216 at least a few seconds before one could open main firebox door 218. This is important because with certain types of wood being burned in a furnace or heater, a sudden inrush of a large quantity of air, as would otherwise occur upon the opening of door 218, could cause a flame from the firebox to flash out through the door, and this may be hazardous. However, if merely a small amount of air is allowed to enter before firebox door 218 is opened, this will be avoided. Thus, if one desires to open firebox door 218, he first must open outside door 210, and thus a delay is effected before one can open door 218. During the interval between opening of the doors, flap 202 would have been open, allowing the necessary inflow of air to prevent the flash out.

Flap 202 also serves one additional purpose, and that is to provide an adjustment for a minimum combustion air inlet into firebox 216. Thus, as shown in FIG. 10, flap 202 has an opening 220 in the flap, and there is pivotally positioned, by means of pin 222, a round plate 224 having different sized openings 226, 228, 230, and 232. Thus, by rotating plate 224 so that one of these openings is in line with opening 220 (FIG. 9), a selected degree of minimum inlet air is effected.

As a further feature of the invention, means are provided to enable doors 220 and 218 to be opened without the necessity of using gloves to avoid a burn. To accomplish this, handle 234 on door 218 and handle 236 on door 200 are formed of wood, and means are provided to direct a stream of cool air along the front interior side of the furnace, and thus over doors 200 and 218. This is effected, as shown in FIG. 11, by a channel 238 through which air may vertically rise, this channel being the region between grate 240 and front interior surface 242 of furnace or heater 214.

Figure 11:
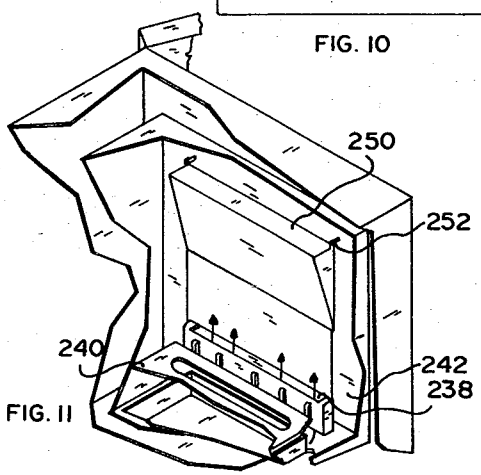
FIG. 11 is a broken pictorial view of the front interior region of a furnace, particularly illustrating an air passageway to provide cooling air across the main, fuel feed, door of the furnace.

As still another feature of this invention, and as illustrated in FIG. 11, an L-shaped flap 250 is pivotally mounted on brackets 252 attached to the inner front side of firebox 216 just inside of main firebox door 218. As constructed, flap 250 normally rests in the position shown, but, for example, with door 218 open, and an item of fuel, such as a log, being pushed into firebox 216 and against flap 250, flap 250 opens backward into the firebox, permitting the essentially free movement of the log into the firebox, but prevents smoke from exiting when door 218 is open.

Remote thermostatic control of furnace 214, particularly when used as a furnace, may be effected by a conventional metallic strip rotary control 260 illustrated in FIGS. 12 and 13. As shown in FIG. 12, a damper 262 on a shaft 264 would be driven by a crank assembly 266 connected to a bi-metallic spring 268, in turn heated by heater coil 270. As shown in FIG. 13, leads 272 and 274 of the control are connected through a conventional heat control thermostat 276 to a source of power, e.g., 24 volts AC. The thermostat is of a type wherein an ambient temperature lower than a set temperature on the thermostat will provide a closed switch which will cause power to be supplied to heating element 270. This causes bi-metallic spring 268 to expand and rotate crank assembly 266 and thus damper 262 to a more open state of damper 262, and thus causing more air to be fed to heater 214, as in the case of the opening of heat controlled damper 156 shown in FIG. 6, when the ambient temperature rises to a point where ambient thermostat 276 would be turned off, heater 270 would cool, and bi-metallic spring 268 would contract and operate to turn crank assembly 266, and thus damper 262, in an opposite or closing direction. The movement of the damper assembly is quite slow, requiring 18 minutes to cycle between open and closed damper positions, and thus a relatively stable temperature output can be obtained from heater 214.

Figure 15:
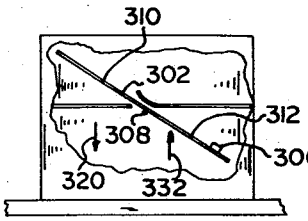
FIG. 15 is a side, broken away, view of a duct with a back flow prevention damper particularly adapted for use with the wood furnace assembly shown in FIG. 8 and the system shown in FIG. 14.

FIG. 14 illustrates a wood furnace 214 constructed in accordance with the foregoing arrangement. It is combined in a system with a second furnace 300, which may be a gas-fired furnace, an oil-fired furnace, or an electricallypowered furnace. As an electrically-powered furnace, it may be either of a resistance heat type or of a heat pump type. As a significant feature of this invention, the furnaces have been coupled to operate safely and compatibly together. This has been accomplished by preventing significant cross circulation between furnaces, that is, recirculation of air movement produced by a fan of one furnace through the other furnace. Second, it has been determined that by a selected range of ratios of air flow normally through the separate furnaces, a safe and effective dual system can be achieved. First, as shown in FIG. 8, wood furnace 214 would include damper 302 (FIGS. 8 and 15) in exit duct 304 which would be normally biased open by weight 306. Damper 302 is supported by pin 308 on duct 304 along a cord of damper 302 which is offset from a center line, with the larger area of the damper being in the upper region 310 compared with lower region 312. Thus, in the event that the fan of wood furnace 214 (as illustrated by fan 16 in FIG. 2) is inoperative, or turned off by virtue of an open switch 314 as shown in FIG. 16, and a fan 316 of second furnace 300 is operated by virtue of a closed switch 318, air flow would tend to move in the direction of arrow 320 in duct 304, causing damper 302 to move to a closed position, and thus prevent recirculation of air from furnace 300 through ducts 304 and 322 of furnace 214. To prevent a back flow or recirculation through furnace 300 when its fan would not normally be on (as by the normal fan switch 318 being open as where it is a heat responsive switch and the temperature of furnace 300 is low), normally open relay 324 has contacts across switch 318, and it is powered through leads 325 and 327 when power is applied to fan 16 of wood furnace 218. Thus, with this arrangement, any time that the fan of wood furnace 214 is on, being an air pressure in the direction of arrows 330 and 332, the fan of the other furnace 300 would be on and provide air pressure acting in the direction of arrows 326 and 328, and thus air from wood furnace 214 would not recirculate through furnace 300. This is aided by the requirement that fan 316 of furnace 300 provide a higher volume of flow, and thus a higher duct pressure than the fan of wood furnace 214. To effect this, the fan of furnace 300 would have a capacity of from 200 to 300 percent grater flow than the fan of wood furnace 214.

A center positioned duct 330 functions as a release duct and includes a pressure operated damper (such as a weight balanced back flow damper) (not shown) which will operate to open in the event of a loss of air pressure as discussed with respect to plate 40 opening and closing opening 38 of the heater shown in FIG. 1. Duct 330 terminates in floor register 332 in an upper level floor 334.

The present invention takes the wood burning heater from its rather basic stages to a safe, reliable heater or furnace which may be employed alone or in conjunction with other heating systems.

Having thus described my invention, what is claimed is:

1. A combustion type heater comprising:

a firebox comprising a combustion chamber heated by the burning of fuel therein;

a plenum around and over said firebox and forming in said plenum an air space, and said plenum having separate inlet and outlet openings;

a third opening in a top region between said inlet and outlet openings of said plenum; and control means including a door movably positioned in said third opening and operable between positions of opening and closure of said third opening, and responsive to a selected magnitude of air movement between said inlet and outlet openings for operating said door to a said closed position, and responsive to less than said selected magnitude of air movement for operating said door to said open position, and said control means comprising:

means for supporting said door in a normally, without substantial air flow, open position with a region of said door extending into said plenum and in a path otherwise traversed by air movement between said inlet and outlet openings, whereby upon the occurrence of air movement, said region of said door is engaged by air movement and said door moved to a said closed position.

2. A heater as set forth in claim 1 wherein said door is pivotally supported on opposite sides of said third opening, and said means for biasing comprises means for supporting said door pivotally on opposite sides of said third opening along an axis which separates said door into two regions, and one of said regions is of a greater weight than the other region and is thereby caused to normally tilt into said plenum;

said axis lies along a direction normal to air flow in said plenum between said inlet opening and outlet opening; and said region of said door of greatest weight lies downstream with respect to air movement between inlet and outlet openings of said axis;

whereby air flow between said inlet and outlet openings impinges on said greatest weight region of said door, causing said door to be rotated to a said closed position.

3. A heater as set forth in claim 2 further comprising a blower having an inlet adapted to receive air, and having an outlet connected to said inlet opening of said plenum.

4. A heater as set forth in claim 3 wherein said inlet of said blower and said outlet of said plenum are generally positioned along a horizontal plane.

5. A heater as set forth in claim 2 including combustion air draft means for selectively, responsive to air temperature, varying the area of an opening into said firebox, and draft directional means for receiving flow from said air draft means for dividing a volume of flow between a first volume and a second volume, and said furnace further including means for directing said first volume of air into an upper portion of said firebox and said second volume of air into a lower portion of said firebox.

6. A heater as set forth in claim 1 which includes:

an outer door forming an outer wall spaced from said firebox; and a relatively small inner door in said firebox positioned to face said outer door, and biasing means for normally biasing said small inner door open, and operating means attached to said outer door for engaging said inner door and operating it closed when said outer door is closed.

7. A heater as set forth in claim 6 which includes an ash clean-out door on a lower portion of said firebox facing said outer door, and said small inner door is formed in said ash clean-out door.

8. A heater as set forth in claim 1 which includes a main, fuel feeding, door.

9. A heater as set forth in claim 8 wherein said fuel feeding door includes door opening means, in turn including a wooden handle.

10. A heater as set forth in claim 8 wherein said firebox includes a plate pivotally suspended across its top and across a top portion of the opening for said main door, whereby said plate provides a reduced effective opening when said main door is open, reducing the tendency for smoke to exit, and yet said plate is movable out of the way as solid fuel is fed through said opening.

11. A heater as set forth in claim 1, and a second heater comprising:

a cool air inlet duct;

a hot air exit duct;

a motor powered fan within the air stream through said ducts; and wherein:

said inlet opening of said plenum of said combustion type heater is connected to said cool air inlet of said second heater, said outlet opening of said plenum of said combustion type heater is connected to said hot air exit of said second heater, a damper is positioned in an air path through said outlet of said combustion type heater leading to said exit duct of said second heater, and said damper includes means responsive to air flow from said outlet opening of said combustion type heater to open said damper and responsive to an opposing air flow from said exit duct of said second heater to close said damper, said combustion type heater includes a motor powered fan positioned to move air through said plenum from said inlet to said outlet openings and a motor coupled to power said fan, first switching means for opening and closing an electrical circuit to said motor powered fan of said combustion type heater, second switching means for coupling electrical power to said motor powered fan of said second heater, and third switching means responsive to power applied to said motor powered fan of said combustion type heater for applying power to said motor powered fan of said second heater, whereby, when said fan of said combustion type heater is powered, said fan of said second heater is also powered, and when said fan of said second heater is powered and said fan of said combustion type heater is not powered, said damper closes, whereby recirculation of air from one heater to another is prevented.

* * * * *